US006029835A

United States Patent [19]

DeJonge

[11] Patent Number: 6,029,835

[45] Date of Patent: Feb. 29, 2000

[54] CHILD RESISTANT SAFETY CAP WITH BUILT-IN AUTO RETRACTING KEY MECHANISM

[75] Inventor: Stuart W. DeJonge, Easton, Pa.

[73] Assignee: Valley Design, Inc., Bloomsbury, N.J.

[21] Appl. No.: 09/223,120

[22] Filed: Dec. 30, 1998

[51] Int. Cl.[7] ..... A61J 1/00; B65D 41/08; B65D 55/02

[52] U.S. Cl. ..... 215/220; 215/206; 215/305

[58] Field of Search ..... 215/207, 201, 215/204, 206, 208, 217, 219, 220, 221, 223, 301, 305, 331; 220/254, 255, 256, 260

[56] References Cited

U.S. PATENT DOCUMENTS

| | | | |
|---|---|---|---|
| 3,151,756 | 10/1964 | Gruen | 215/207 |
| 3,260,393 | 7/1966 | Roberts et al. . | |
| 3,516,563 | 6/1970 | Durso et al. | 215/221 |
| 3,777,924 | 12/1973 | Kayser et al. . | |
| 4,319,690 | 3/1982 | Birrell et al. . | |
| 4,998,632 | 3/1991 | Morris, Sr. . | |
| 5,115,928 | 5/1992 | Drummond, Jr. . | |
| 5,344,035 | 9/1994 | Manera | 215/219 |
| 5,615,787 | 4/1997 | Morris, Sr. | 215/217 |
| 5,638,970 | 6/1997 | Garby et al. | 215/219 |

*Primary Examiner*—Allan N. Shoap
*Assistant Examiner*—Niki M. Eloshway
*Attorney, Agent, or Firm*—Kenneth P. Glynn, Esq.

[57] ABSTRACT

A child resistant safety cap for containers includes an outer cap, an inner cap, at least one retractable-extendable key arm and a biasing spring. The outer cap has a top and a sidewall with a plurality of openings for retraction and extension of the key arms therethrough, and the top has an engaging mechanism for engaging and disengaging the key arms. The inner cap is contained within the outer cap, has a sidewall and a top, with a slide mechanism for slideably attaching a plurality of key arms. The inner cap is a predetermined height less than the inside vertically slidable within the outer cap. The inner cap has a first vertical position away from the top of the outer cap wherein said engaging mechanism of the outer cap and the connecting mechanism of the plurality of key arms are disengaged, and the inner cap has a second vertical position, toward the top of the outer cap wherein the engaging mechanism and the connecting mechanism are engaged. The inner cap also has threading on its inside for screwing onto and off a threaded container.

18 Claims, 4 Drawing Sheets

CHILD RESISTANT SAFETY CAP WITH BUILT-IN AUTO RETRACTING KEY MECHANISM

BACKGROUND OF THE INVENTION

1. Field of the Invention

The present invention relates to child resistant safety cap and more particularly to such caps with built-in, automatically retracting key arm mechanisms. These caps are especially user friendly for arthritics and other users who have dexterity difficulties.

2. Information Disclosure Statement

The following is representative of the prior art for child resistant safety caps:

U.S. Pat. No. 3,260,393 to Simon Roberts et al. describes a safety cap for a container which comprises an inner cap member which is provided with means for sealing engagement with a container, an outer cap member telescopically mounted over said inner cap member and normally rotatable independently thereof and movable longitudinally thereof, a plate mounted in said outer cap member, means for releasably connecting said plate to one of said cap members, drive clutch mechanism for connecting said members together for positive drive action for rotation of the inner cap member when the outer cap member is rotated in one direction to remove the safety cap from a container, and for torque limiting, releasable drive action for rotation of the inner cap member when the outer cap member is rotated in another direction to attach the safety cap to the container, and including, a clutch driven means on the other of said cap members, and clutch drive means on said plate selectively engageable with said clutch driven means, and spring means mounted between said cap members for normally biasing the clutch drive and driven means apart to inoperative positions to allow independent rotation of the outer cap member relative to the inner cap member.

U.S. Pat. No. 3,777,924 to James H. Kayser et al. describes a safety closure which restricts the opening of containers by children. The closure has an inner cap which is operable to open the container upon manual manipulation of a grasping surface on the inner cap. The closure also includes an inseparable outer cap which will not operate directly to open the closure, but which must be moved against the bias of a spring from a position at which it encloses the grasping surface to a position at which the grasping surface may be manually manipulated. The outer cap may be engageable with the inner cap to move the inner cap to a sealing position on the container by manipulation of the outer cap, or the inner cap may be spring biased to its closed position.

U.S. Pat. No. 4,319,690 to Stewart H. Birrell et al. describes a safety closure and container assembly which includes a container and a closure comprising outer and inner caps which may be attached to the container by conventional capping machines. In first, second, third and fourth embodiments of the invention, the inner cap is formed with a circular dome-shaped top panel with a skirt portion projecting axially therefrom. The projecting skirt portion is threaded on its interior surface for engagement with a conventionally threaded container finish. A plurality of upwardly extending and spaced apart drive members are integrally molded with the periphery of the top panel. A plurality of ramped ratchet lugs also extend upwardly from the upper surface of the top panel. The outer cap has a circular end wall with an axially projecting second skirt portion.

U.S. Pat. No. 4,998,632 to Glenn H. Morris, Sr. describes a condition indicating child resistant cap assembly including an inner cap and an outer cap rotatably mounted on the inner cap. An indicating post is connected to the top wall of the inner cap in alignment with an opening in the top wall of the outer cap. When the cap assembly is in the child resistant mode, the outer cap is spaced upwardly from the inner cap and is free rotatable in one direction thereon. The post is wholly contained within the space between the inner and outer caps and therefore not visible outside the cap assembly to indicate the cap assembly is in the child resistant mode. When the cap assembly is in the non-child resistant mode, the outer cap is rotated in the opposite direction until it snaps, and is moved downwardly toward the inner cap and rotated in the first mentioned direction, whereby the inner and outer caps are interlocked for removal from a container. The post extends outwardly of the cap assembly and therefore is visible to indicate that the cap assembly is in the non-child resistant mode.

U.S. Pat. No. 5,115,928 to Archie G. Drummond, Jr. describes a convertible child-resistant closure assembly which is described herein. It includes a closure and shell. The shell mounts a latching key and the closure provides a complementary latch. An alignment structure provides for aligning the latch and key for movement of the latching key from a mode in which the key is inactive to a mode in which it engages the latch to inactive the child-resistant function of the closure. In that position the shell and closure are corotatable in both clockwise and counterclockwise directions. Spring fingers may be provided to elevate the shell relative to the closure to provide an additional child-resistant function. The latching key may be hingedly or slideably secured to the shell.

Notwithstanding the prior art, the present invention is neither taught nor rendered obvious thereby.

SUMMARY OF THE INVENTION

The present invention is a child resistant safety cap for containers, which includes an outer cap, an inner cap, at least one retractable-extendable key arm and a biasing spring. The outer cap has a top and a sidewall with an inside predetermined height and a plurality of openings for retraction and extension of the key arms therethrough, and the top has an engaging mechanism for engaging and disengaging the key arms. The inner cap is contained within the outer cap, has a sidewall and a top, and the top of the inner cap has a slide mechanism for slideably attaching a plurality of key arms. The inner cap has a predetermined height less than the inside predetermined height of the outer cap so as to be vertically slidable therein. The inner cap has a first vertical position, being a lower position away from the top of the outer cap wherein said engaging mechanism of the outer cap and the connecting means of the plurality of key arms are disengaged, and the inner cap has a second vertical position, being a higher position toward the top of the outer cap wherein the, engaging mechanism of the outer cap and the connecting means of the plurality of key arms are engaged. The inner cap also has threading on its inside for screwing onto and off a correspondingly threaded container.

The plurality of key arms are located on the top of the inner cap and under the top of the outer cap, and connected to the slide mechanism of the top of the inner cap, the plurality of key arms having a connecting mechanism for engaging and disengaging with the engaging mechanism of the top of the outer cap. The key arms have a first, closed position wherein they are retracted and do not extend beyond the sidewall of the outer cap, and a second, open position wherein they are extended and do extend through and beyond the plurality of openings of the outer cap sidewall. There is also at least one spring element located between the outer cap and the inner cap, biasing the inner cap into its lower position away from the top of the outer cap. Thus, when the child resistant safety cap is on a threaded container in its position with the engaging mechanism disengaged, being a normal rest position, the outer cap will freely rotate about the inner cap in at least one direction to prevent opening, and when the outer cap is pressed down to engage the engaging mechanism with the plurality of key arms, and the outer cap is rotated while being pressed down, the plurality of the key arms are extended through the outer cap sidewall openings and then both the inner cap and the outer cap may be simultaneously rotated by rotation of the outer cap to permit opening.

BRIEF DESCRIPTION OF THE DRAWINGS

The present invention should be more fully understood when the specification herein is taken in conjunction with the drawings appended hereto wherein.

DETAILED DESCRIPTION OF THE PRESENT INVENTION

The present invention relates to child resistant safety cap and more particularly to such caps with built-in, automatically retracting key arm mechanisms. These caps are especially user friendly for arthritics and other users who have dexterity difficulties. Thus, when the present invention cap is properly aligned, pressed down and rotated, key arms automatically extend outwardly to then able the user to use the key arms as handles and further rotate for ease of opening. When the present invention cap is rotated in a closed direction, the arms will retract and the cap will be tightly sealed and in a normal rest position where simple rotation without alignment and pressing will prevent reopening.

The main features of the present invention child resistant safety cap are set forth in the Summary above. The individual components, i.e. the inner cap, the outer cap, the key arms and the spring, may be constructed of any available material or combinations of materials, including plastics, ceramics, cermets, glass or otherwise, but plastic is preferred. The spring itself may be metal or other spring material, but plastic is preferred. Further, in preferred embodiments, the spring is a leaf spring which is unistructurally molded as an integral part of either the inner cap or the outer cap. Additionally, the general configuration of the inner and outer cap is round, but other configurations could be operable without exceeding the scope of the present invention. For example, the outside of the inner cap could function with flat segment outside surfaces such as a decagon, as well as elliptical shapes or other non-circular shapes, as long as the functional aspects were not impeded, i.e. the outer cap were still able to rotate freely thereabout. Also, for example, the outside shape of the outer cap could likewise be other than round. However, to minimize materials of construction consumption and maximize ease of function, circular shapes are preferred.

Referring to FIGS. 1 through 8 and FIGS. 9 through 20, identical parts are identically numbered and may not be affirmatively discussed with every Figure and so the Figures should be viewed collectively.

Figure 1:
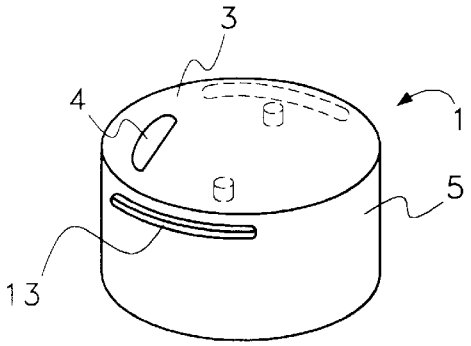
FIGS. 1, 2 and 3 show an oblique view, a bottom view and a side cut view respectively of a present invention child resistant safety cap outer cap preferred embodiment.
Figure 3:
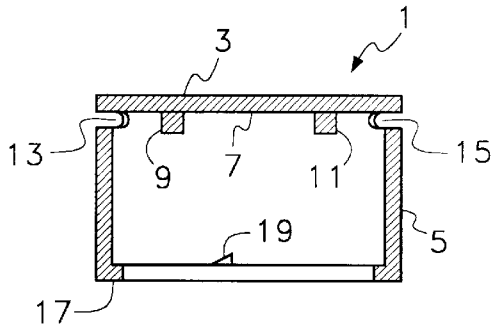
Figure 2:
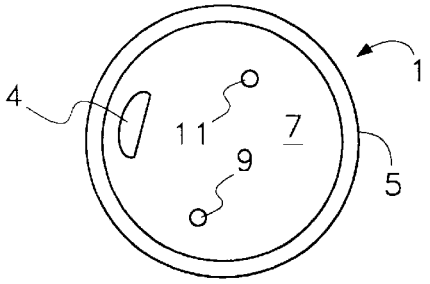

Referring now to FIGS. 1 through 3, there is shown an oblique view, a bottom view and a side cut view respectively of a present invention child resistant safety cap outer cap 1 which has a top 3 and a side wall 5. At the top of side wall 5 are orifices 13 and 15 for extension and retraction of key arms discussed below. Additionally, there is an indicia orifice 4 for proper alignment of outer cap 1 with a corresponding inner cap. On the underside 7 of top 3 are protrusions 9 and 11. These protrusions 9 and 11 are adapted to fit into corresponding recesses or orifices in key way arms. Additionally, there is provided a ledge 17 for containing an inner cap and for providing ratchets or ramps such as ramp 19 for one-way engagement with corresponding ratchets or ramps on an inner cap.

Figure 4:
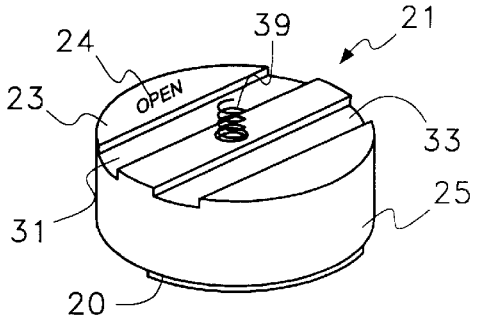
FIGS. 4 and 5 show an oblique view and a side cut view of a present invention inner cap for use with the outer cap shown in FIGS. 1, 2 and 3.
Figure 5:
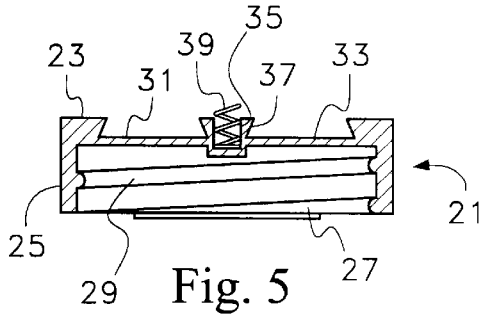

FIGS. 4 and 5 show oblique and side cut views of inner cap 21 which has been adapted to nest within outer cap 1 described above. It includes a top 23 and a side wall 25 with indicia 24 on top 23 and ratchet section 20 on side wall 25. Also, top 23 includes two female tracks 31 and 33 for slidable engagement of key arms. Spring 39 is also shown on top 23 and when inner cap 21 is contained within outer cap 1, spring 39 biases inner cap 21 to a downward, rest position away from top 3 of outer cap 1. More specifically, in FIG. 5, there is shown a recess 37 for spring 39 to hold it into position and tracks 31 and 33 are shown to be tapered inwardly so as to contain key arms. Additionally, side wall 25 of inner cap 21 has threads 27 and 29 for engagement with a threaded container.

Figure 6:
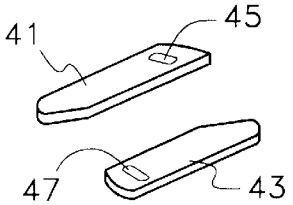
FIGS. 6 and 7 respectively show oblique views and end views of key arms used in a present invention child resistant safety cap in conjunction with the outer cap and inner cap shown in FIGS. 1 through 5.
Figure 7:
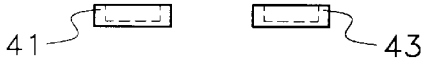

FIGS. 6 and 7 show oblique and end views of two key arms 41 and 43. These contain orifices 45 and 47 for engagement and disengagement with protrusions 9 and 11 shown in FIGS. 2 and 3 above.

Figure 8:
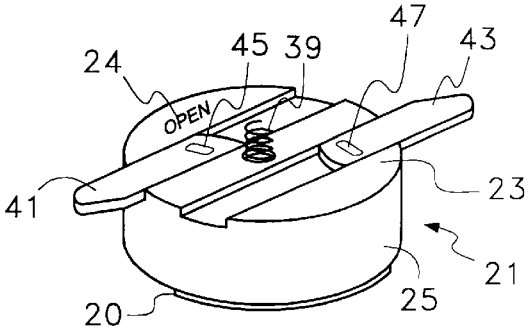
FIG. 8 shows an oblique view of the inner cap shown in FIGS. 4 and 5 with the key arms shown in FIGS. 6 and 7.

FIGS. 8 shows inner cap 21 with key arms 41 and 43 in their extended position. As can be seen, when outer cap 1 is properly aligned with the indicia orifice 4 and indicia 24 and pressed down and rotated, protrusions 9 and 11 will fit into orifices 45 and 47 and rotation of outer cap 1 will cause key arms 41 and 43 to extend outwardly through orifices 13 and 15 (FIG. 3) and will extend sufficiently outwardly to provide handles for further rotation and opening of both the inner and outer caps simultaneously. In preferred embodiments, the fit or torque between the inner cap and the container will be greater than the torque to actuate the key arms. In other words, the aforesaid torque relationships will aid in assuring that the key arms extend before the inner cap unscrews from the container.

Figure 9:
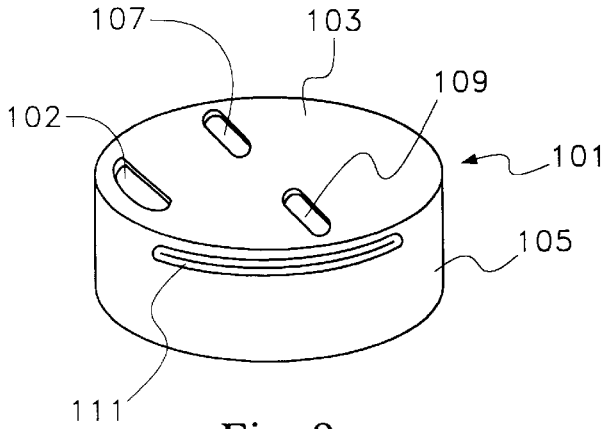
FIGS. 9 and 10 shown an oblique view and a side cut view of an alternative preferred embodiment present invention outer cap and FIGS. 11 and 12 show top views of a connected pair of key arms in their retracted and extended position respectively.
Figure 10:
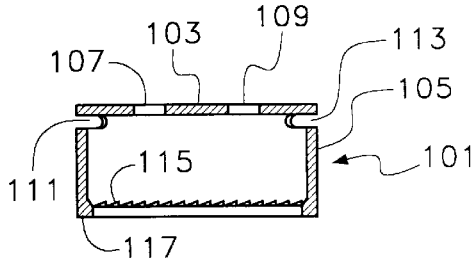
Figure 11:
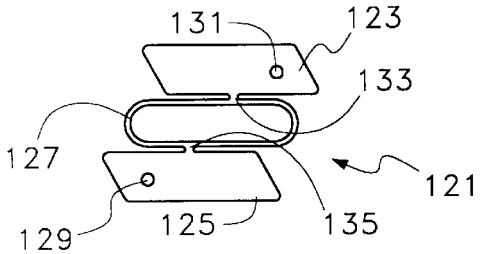

Referring to FIGS. 9 through 20, there is shown a present invention alternative embodiment child resistant safety cap for threaded containers. FIGS. 9 and 10 show an oblique view and a side cut view respectively of a present invention child resistant safety cap outer cap 101 which has a top 103 and a side wall 105. At the top of side wall 105 are key arm extension orifices, such as orifice 111 for extension and retraction of key arms discussed below. There is an indicia orifice 102 for proper alignment of outer cap 101 with a corresponding inner cap. On the top 103 are key arm protrusion-receiving orifices 107 and 109. These orifices 107 and 109 are adapted to receive corresponding protrusion in key way arms. Additionally, there is provided a ledge 117 for containing an inner cap. There are ratchets or ramps such as ramp 115 for one-way engagement with correspondingly ratchets or ramps on an inner cap.

FIGS. 11 through 14 show two top views, an end view and an oblique view of a pair 121 of key arms 123 and 125, which are connected by a flexible connecting ring 127 with attachment segments 133 and 135. Protrusions 129 and 131 are adapted to fit into orifices 107 and 109 when properly aligned and outer cap 101 is pressed down and rotated. The rotation will move key arms 123 and 125 from the rest position shown in FIG. 11 to the extended position shown in FIG. 12.

Figure 13:
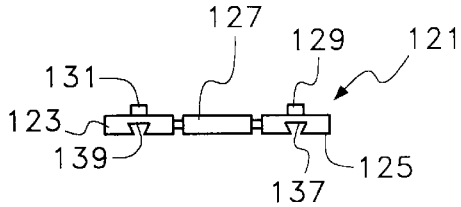
FIGS. 13 and 14 show end views and perspective views respectively of the pair of key arms of the present invention shown in FIGS. 11 and 12.
Figure 12:
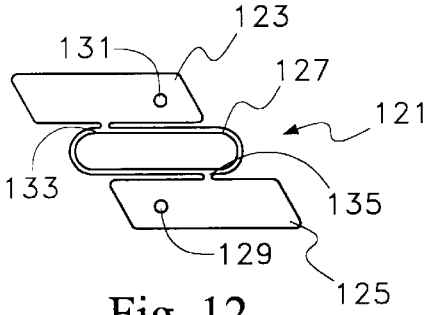
Figure 14:
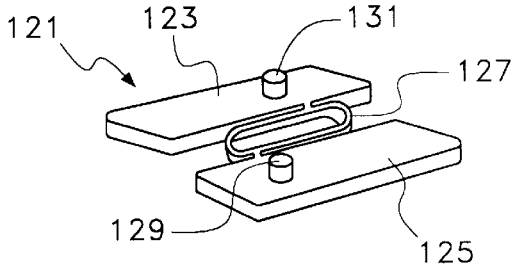
Figure 15:
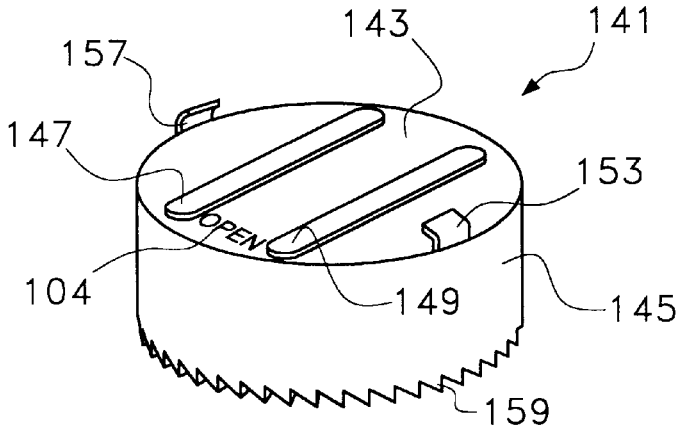
FIGS. 15 and 16 shown an oblique view and a side cut view respectively of a present invention inner cap for use with the outer cap shown in FIGS. 9 and 10 and the pair of key arms shown in FIGS. 11, 12, 13 and 14.
Figure 16:
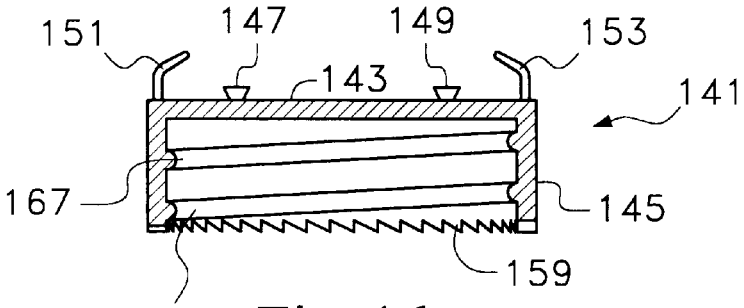

FIGS. 15 and 16 show oblique and side cut views of inner cap 141 which has been adapted to nest within outer cap 101 described above. It includes a top 143 and a side wall 145 with indicia 104 on top 143. There is a ratchet section 159 on side wall 145, as shown. Also, top 143 includes two male tracks 147 and 149 for slidable engagement of the female tracks 137 and 139 of key arms 123 and 125 (FIG. 13). Springs 151 and 153 are also shown on top 143 and when inner cap 141 is contained within outer cap 101, spring 151 and 153 bias inner cap 141 to a downward, rest position away from top 143 of outer cap 101. More specifically, the springs 151 and 153 are living hinge springs and are unistructurally formed as an integral part of inner cap 141 when it is molded. Additionally, side wall 145 of inner cap 141 has threads 167 and 169 for engagement with a threaded container. Finally, ratchets 159 of inner cap 141 are arranged for engagement with ratchets 115 of outer cap 101 when inner cap 141 is in its rest position (when the key arms are disengaged from the top of the outer cap) and outer cap 101 is rotated in a closing direction, clockwise, to complete closure and these ratchets slide past one another when outer cap is rotated counterclockwise to prevent opening, until engagement of the key arms is effected for opening.

Figure 17:
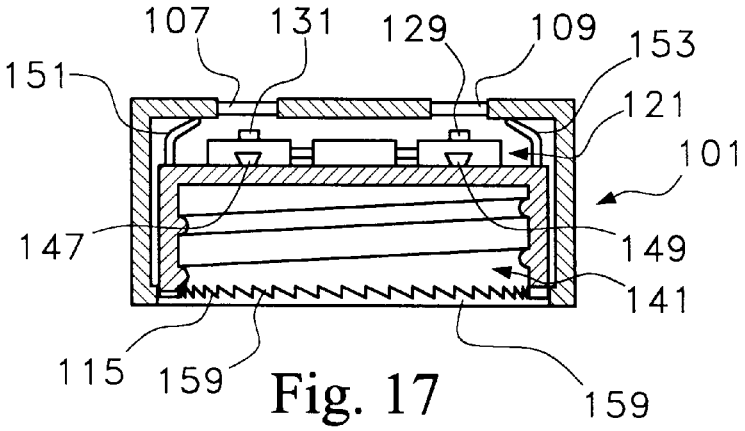
FIG. 17 shows a side cut view of an assembled present invention child resistant safety cap using the components illustrated in FIGS. 9 through 15 above.

FIG. 17 shows a side cut view of inner cap 141, key arms pair 121 and outer cap 101 assembled. As can be seen, when outer cap 101 is properly aligned with its indicia orifice and the indicia of inner cap 141 and pressed down and rotated, protrusions 129 and 131 will fit into orifices 107 and 109 and rotation of outer cap 101 will cause key arms 123 and 125 to extend outwardly through orifices 111 and 113 (FIG. 10) and will extend sufficiently outwardly to provide handles for further rotation and opening of both the inner and outer caps simultaneously.

Figure 18:
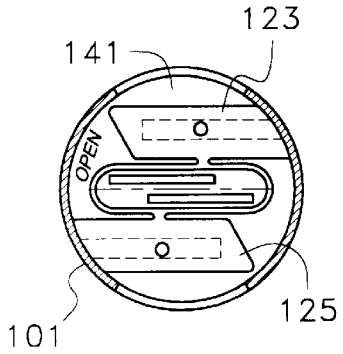
FIG. 18 illustrates a top cut view of the assembled cap shown in FIG. 17 and FIGS. 19 and 20 show see-through top views thereof; and, FIGS. 21 and 22 show side cut views of alternative embodiment present invention child resistant safety cap inner cap and outer cap, respectively.
Figure 19:
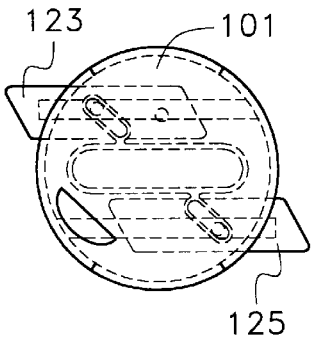
Figure 20:
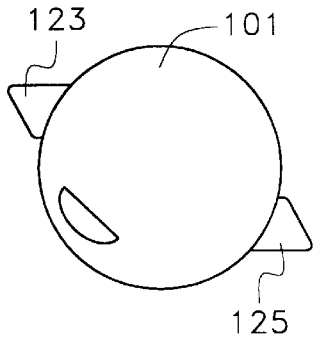

FIGS. 18, 19 and 20 show top views of the assemblage shown in FIG. 17, with FIG. 18 being a cut top view, FIG. 19 being a see-through top view and FIG. 20 being a simple top view. Thus, FIG. 18 shows the key arms 123 and 125 at rest and FIGS. 19 and 20 show them extended.

Figure 21:
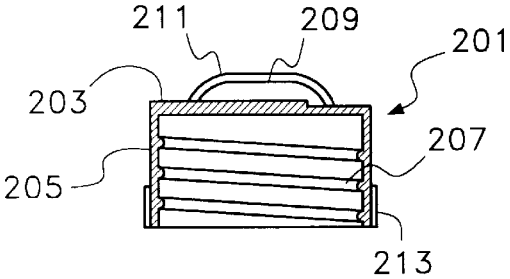
Figure 22:
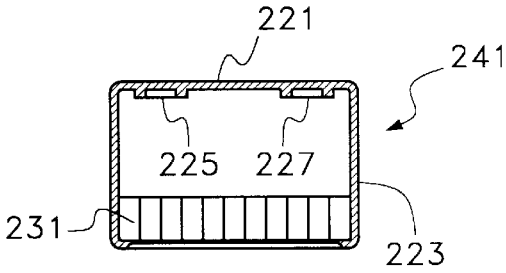

FIG. 21 shows a front cut view of another alternative embodiment present invention inner cap 201 with a top 203 and a sidewall 205. Leaf springs 211 and 209 are shown on top, and means for slidably connecting key arms are also included (not shown). There are threads 207 on the inside of sidewall 205 and on the outside of sidewall 205 are one-way vertical ratchets 213 which mesh-to-close in the rest position when inner cap 201 is contained with key arms within outer cap 241 of FIG. 22. Thus, FIG. 22 shows a cut view of outer cap 241 with top 221 having key arm engagement means 225 and 227, and with sidewall 223 having inside vertical ratchets 231.

Obviously, numerous modifications and variations of the present invention are possible in light of the above teachings. It is therefore understood that within the scope of the appended claims, the invention may be practiced otherwise than as specifically described herein.

What is claimed is:

1. A child resistant safety cap for containers, which comprises:

(a) an outer cap having a sidewall and a top, said sidewall having an inside predetermined height, said sidewall having a plurality of openings for retraction and extension of key arms therethrough, said top having engaging means for engaging and disengaging connecting means of said key arms;

(b) an inner cap contained within said outer cap, said inner cap having a sidewall and a top, said top of said inner cap having slide means for slideably attaching a plurality of key arms, said inner cap having a predetermined height less than the inside predetermined height of said outer cap so as to be vertically slidable therein, said inner cap having a first vertical position, being a lower position away from said top of said outer cap wherein said engaging means of said outer cap and said connecting means of said plurality of key arms are disengaged, and said inner cap having a second vertical position, being a higher position toward said top of said outer cap wherein said engaging means of said outer cap and said connecting means of said plurality of key arms are engaged, said inner cap also having threading on its inside for screwing onto and off a correspondingly threaded container;

(c) a plurality of key arms located on the top of said inner cap and under the top of said outer cap, and connected to said slide means of said top of said inner cap, said plurality of key arms having connecting means for engaging and disengaging with said engaging means of said top of said outer cap, said key arms having a first, closed position wherein they are retracted and do not extend beyond the sidewall of said outer cap, and a second, open position wherein they are extended and do extend through and beyond said plurality of openings of said outer cap sidewall; and, (d) at least one spring element located between said outer cap and said inner cap, biasing said inner cap into its lower position away from said top of said outer cap;

wherein when said child resistant safety cap is on a threaded container in its position with said engaging means disengaged, from said connecting means being a normal rest position, said outer cap will freely rotate about said inner cap in at least one direction to prevent opening, and when said outer cap is pressed down to engage said engaging means with said plurality of key arms, and said outer cap is rotated while being pressed down, said plurality of key arms are extended through said outer cap sidewall openings and then both said inner cap and outer cap may be simultaneously rotated by rotation of said outer cap utilizing the key arms as handles to permit opening.

2. The child resistant safety cap of claim 1 wherein said outer cap and said inner cap both have circular outside top view shapes and circular inside bottom view shapes.

3. The child resistant safety cap of claim 1 wherein said connecting means of said plurality of key arms is at least one protrusion located on said plurality of keys and extending upwardly toward said top of said outer cap, and said engaging means of said outer cap is at least one corresponding orifice into which said at least one protrusion is insertable.

4. The child resistant safety cap of claim 1 wherein said connecting means of said plurality of key arms is at least one orifice located on said plurality of keys, and said engaging means of said outer cap is at least one corresponding protrusion which is insertable into said at least one orifice.

5. The child resistant safety cap of claim 1 wherein said slide means for slideably attaching a plurality of key arms is one of a male and female track and said plurality of key arms includes the other of said male and female track.

6. The child resistant safety cap of claim 1 wherein said at least one spring is connected to one of said inner cap and said outer cap.

7. The child resistant safety cap of claim 6 wherein said connecting means of said plurality of key arms is at least one protrusion located on said plurality of keys and extending upwardly toward said top of said outer cap, and said engaging means of said outer cap is at least one corresponding orifice into which said at least one protrusion is insertable.

8. The child resistant safety cap of claim 6 wherein said slide means for slideably attaching a plurality of key arms is one of a male and female track and said plurality of key arms includes the other of said male and female track.

9. The child resistant safety cap of claim 1 wherein said outer cap includes an indicia orifice and said inner cap includes an indicia for alignment with said indicia orifice of said outer cap so as to simultaneously align said engaging means of said outer cap with said connecting means of said plurality of key arms.

10. The child resistant safety cap of claim 1 wherein said inner cap and said outer cap include sidewall closure engagement means which permits engagement thereof for closing said outer cap and inner cap simultaneously when said child resistant safety cap is in its rest position with said engaging means of said outer cap disengaged and said inner cap is in its lower position, and said closure engagement means includes ramping in rotational direction opposite a closing direction to permit free rotation of said outer cap relative to said inner cap in that direction.

11. The child resistant safety cap of claim 10 wherein said outer cap and said inner cap both have circular outside top view shapes and circular inside bottom view shapes.

12. The child resistant safety cap of claim 10 wherein said connecting means of said plurality of key arms is at least one protrusion located on said plurality of keys and extending upwardly toward said top of said outer cap, and said engaging means of said outer cap is at least one corresponding orifice into which said at least one protrusion is insertable.

13. The child resistant safety cap of claim 10 wherein said connecting means of said plurality of key arms is at least one orifice located on said plurality of keys, and said engaging means of said outer cap is at least one corresponding protrusion which is insertable into said at least one orifice.

14. The child resistant safety cap of claim 10 wherein said slide means for slideably attaching a plurality of key arms is one of a male and female track and said plurality of key arms includes the other of said male and female track.

15. The child resistant safety cap of claim 10 wherein said at least one spring is connected to one of said inner cap and said outer cap.

16. The child resistant safety cap of claim 15 wherein said connecting means of said plurality of key arms is at least one protrusion located on said plurality of keys and extending upwardly toward said top of said outer cap, and said engaging means of said outer cap is at least one corresponding orifice into which said at least one protrusion is insertable.

17. The child resistant safety cap of claim 15 wherein said slide means for slideably attaching a plurality of key arms is one of a male and female track and said plurality of key arms includes the other of said male and female track.

18. The child resistant safety cap of claim 10 wherein said outer cap includes an indicia orifice and said inner cap includes an indicia for alignment with said indicia orifice of said outer cap so as to simultaneously align said engaging means of said outer cap with said connecting means of said plurality of key arms.

* * * * *